US011737546B2

(12) United States Patent
Takahashi

(10) Patent No.: US 11,737,546 B2
(45) Date of Patent: Aug. 29, 2023

(54) APPLICATOR

(71) Applicant: WINTRADING CO., LTD, Saitama (JP)

(72) Inventor: Hiroaki Takahashi, Saitama (JP)

(73) Assignee: WINTRADING CO., LTD., Saitama (JP)

( * ) Notice: Subject to any disclaimer, the term of this patent is extended or adjusted under 35 U.S.C. 154(b) by 159 days.

(21) Appl. No.: 17/294,119

(22) PCT Filed: Nov. 20, 2018

(86) PCT No.: PCT/JP2018/042876
§ 371 (c)(1),
(2) Date: May 14, 2021

(87) PCT Pub. No.: WO2020/100312
PCT Pub. Date: May 22, 2020

(65) Prior Publication Data

US 2022/0007812 A1 Jan. 13, 2022

(30) Foreign Application Priority Data

Nov. 16, 2018 (JP) ..... 2018-215611

(51) Int. Cl.
*A45D 34/04* (2006.01)

(52) U.S. Cl.
CPC ..... *A45D 34/04* (2013.01); *A45D 34/042* (2013.01)

(58) Field of Classification Search
CPC ..... A45D 34/04; A45D 34/042
See application file for complete search history.

(56) References Cited

U.S. PATENT DOCUMENTS 9,119,457 B2 * 9/2015 Ooba ..... A45D 34/04
10,299,562 B2 * 5/2019 Takahashi ..... A45D 19/00
(Continued)

FOREIGN PATENT DOCUMENTS

JP 45-4805 2/1970
JP 61-148099 7/1986
(Continued)

OTHER PUBLICATIONS

International Search Report dated Jan. 22, 2019 in International (PCT) Application No. PCT/JP2018/042876.

*Primary Examiner* — Jennifer C Chiang
(74) *Attorney, Agent, or Firm* — Wenderoth, Lind & Ponack, L.L.P.

(57) ABSTRACT

An applicator in which a through-hole in a plug cannot be distorted and therefore an air flow passage for a liquid application material can be secured, and liquid leakage from a core material impregnated with a liquid application material cannot be caused upon uncapping the applicator. The applicator includes: a body; an application member housed in the body; a storage section in which the liquid application material is stored; and a plug positioned on the rear end of the application member to penetrate and hold the application member into and in a through-hole that is bored in the plug, and can allow an rear-end-side tip part of the application member to be exposed on the storage section side, wherein the shape of the through-hole is formed in such a manner that the width of a gap between the through-hole and the application member penetrating in the through-hole can be adjusted.

3 Claims, 7 Drawing Sheets

(56) References Cited

U.S. PATENT DOCUMENTS

| | | | | |
|---|---|---|---|---|
| 10,827,816 | B2 * | 11/2020 | Takahashi | B43K 8/02 |
| 11,370,243 | B2 * | 6/2022 | Hori | B43K 8/06 |
| 2004/0161291 | A1 | 8/2004 | Noguchi et al. | |
| 2014/0241781 | A1 | 8/2014 | Ooba | |

FOREIGN PATENT DOCUMENTS

| | | |
|---|---|---|
| JP | 6-45776 | 6/1994 |
| JP | 11-48678 | 2/1999 |
| JP | 2000-15985 | 1/2000 |
| JP | 2002-127666 | 5/2002 |
| JP | 2004-167914 | 6/2004 |
| JP | 2004-344858 | 12/2004 |
| JP | 2008-254311 | 10/2008 |
| JP | 2012-30405 | 2/2012 |
| JP | 2013-102910 | 5/2013 |
| JP | 2014-100898 | 6/2014 |
| JP | 2014-148069 | 8/2014 |
| JP | 2018-94875 | 6/2018 |
| WO | 2017/026176 | 2/2017 |

* cited by examiner

Fig.6 - PRIOR ART
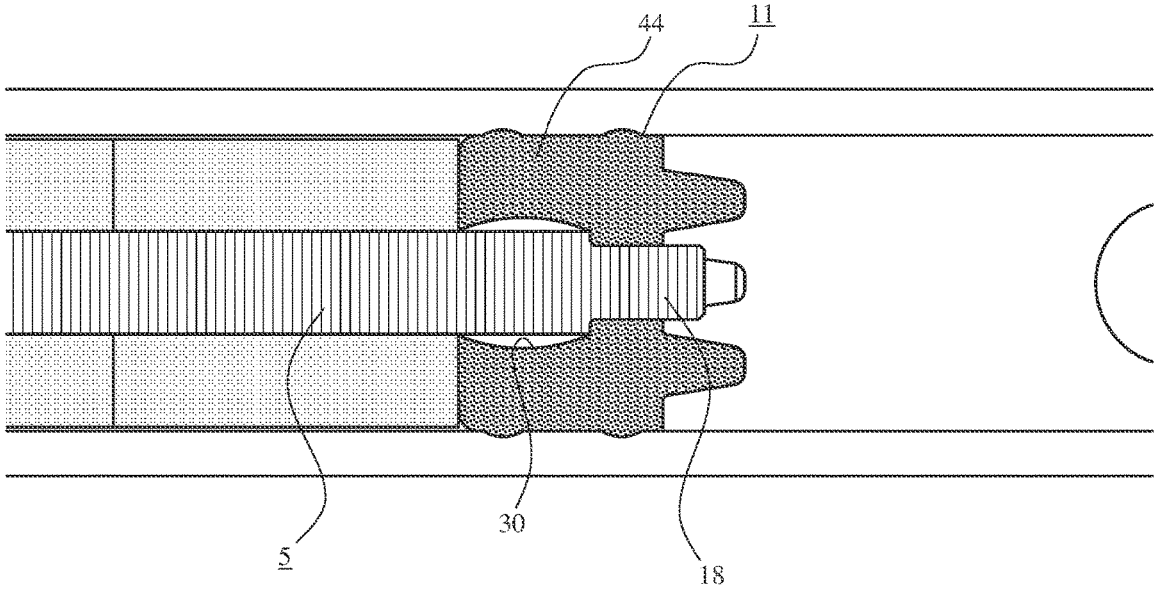

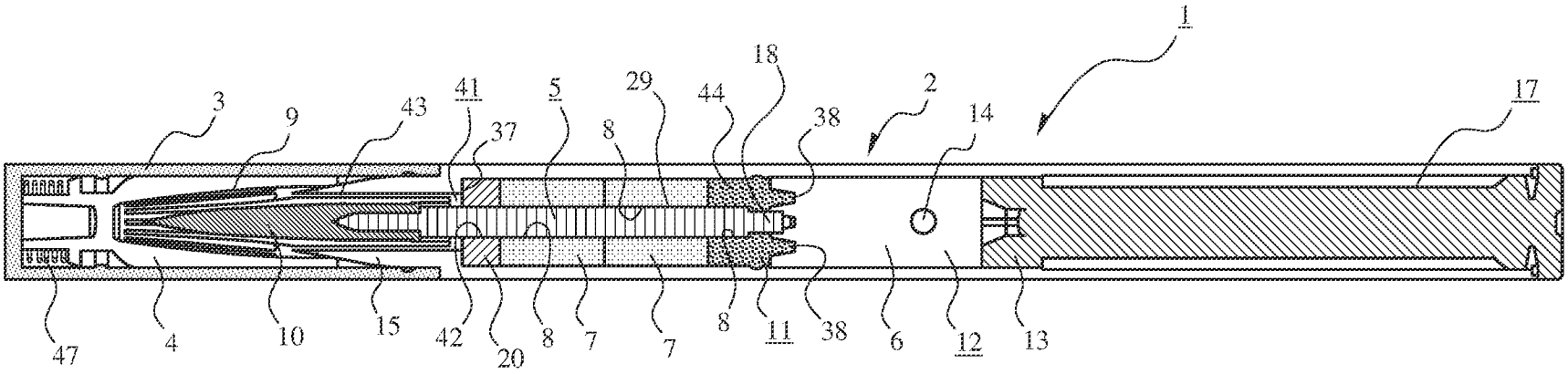
Fig. 7- PRIOR ART

APPLICATOR

TECHNICAL FIELD

The present invention relates to an applicator used by infiltrating a liquid application material stored inside of, for example, a cosmetic tool such as an eyeliner or eyebrow, or a partial gray hair dyeing tool for hair, eyebrows or the like into an application member and applying or painting in the liquid application material by a tip application section.

BACKGROUND ART

In the prior art, an applicator for an eyeliner or the like is generally known, in which a liquid application material is internally stored, and this liquid application material is absorbed and infiltrated into an application member formed of a core material including a fiber member or the like, and is applied or painted using a tip application section of the application member.

For example, depending on the use modes of the applicators, viscosity and materials of the liquid application materials of these applicators are different, and the amount of the liquid application material stored in the storage section is also different.

Therefore, a plug capable of adjusting a discharge amount of the liquid application material depending on a plurality of types of liquid application materials having different viscosities and materials, including a case where the storage amount is different, plays a very important function.

In the prior art, the plug is formed of a so-called thermoplastic synthetic resin member, and a base material of the thermoplastic synthetic resin is put into a mold and heated to form a predetermined plug shape.

However, in recent years, the plug has at least two through-holes having different diameters formed inside, and the through-holes are formed in a polygonal shape in many cases. When the base material including the thermoplastic synthetic resin member is put into the mold and heated to form the shape as described above, a cooling temperature on the outside of the mold and a cooling temperature on the inside of the mold are different as illustrated in FIG. 6. Therefore, there is a problem that a contracting action of the plug in the inner part of the mold is stronger than that of the outer part, and as a result, the through-hole of the plug is distorted disadvantageously.

There is also a problem in the cap of the applicator. That is, when the cap is removed with an excessively strong tightening force, a sealing force of the cap is strong. Therefore, a liquid leakage may occur from the core material into which the liquid application material is infiltrated.

CITATION LIST

Patent Documents

Patent Document 1: Japanese Unexamined Patent Application Publication No. 11-48678

Patent Document 2: Japanese Unexamined Patent Application Publication No. 2013-102910

Patent Document 3: Japanese Unexamined Patent Application Publication No. 2004-344858

SUMMARY OF INVENTION

Technical Problem

Therefore, in order to address the aforementioned problems of the prior art, the present invention provides an applicator capable of preventing distortion of the through-hole of the plug, reliably securing an air flow passage of the liquid application material, and preventing liquid leakage from the core material into which the liquid application material is infiltrated upon uncapping of the applicator.

Solution to Problem

According to the present invention, there is provided an applicator comprising: a substantially cylindrical body; a substantially columnar application member housed in the body; a storage section that stores a liquid application material with which the application member is impregnated; and a substantially columnar plug that is positioned on a rear end side of the application member in the body so as to allow the application member to be inserted into and held by a through-hole bored in the plug and allow a rear-end-side tip part of the application member to be exposed on a storage section side, the through-hole being shaped such that a width of a gap between the through-hole and the application member inserted into the through-hole is adjustable, wherein the plug is formed by putting a thermoplastic synthetic resin member as a material into a mold and injection-molding the resin member in the mold such that a radial thickness on both end sides of a plug base is an outer peripheral surface of the thickness of the plug base as it is, and an outer peripheral surface of a central portion side has a ring-shaped depressed portion formed as a depressed groove portion depressed inward.

Alternatively, there is provided an applicator comprising: a substantially cylindrical body; a substantially columnar application member housed in the body; a storage section that stores a liquid application material with which the application member is impregnated; a substantially columnar plug that is positioned on a rear end side of the application member in the body so as to allow the application member to be inserted into and held by a through-hole bored in the plug and allow a rear-end-side tip part of the application member to be exposed on a storage section side, the through-hole being shaped such that a width of a gap between the through-hole and the application member inserted into the through-hole is adjustable; and a substantially cylindrical cap that caps a front-end-side opening of the body, wherein the cap has a sloped inner peripheral surface formed such that a thickness of an inner peripheral surface in a vicinity of an opening of the cap is gradually reduced toward an opening side, and a diameter of the inner peripheral surface increases, and a depressed groove space portion depressed in a ring shape is formed on the inner peripheral surface of the cap inward of the portion where the sloped inner peripheral surface is formed in a cap axial direction, so as to cause the depressed groove space portion to serve as a space for releasing an internal pressure of the cap.

Alternatively, there is provided an applicator comprising: a substantially cylindrical body; a substantially columnar application member housed in the body; a storage section that stores a liquid application material with which the application member is impregnated; a substantially columnar plug that is positioned on a rear end side of the application member in the body so as to allow the application member to be inserted into and held by a through-hole bored in the plug and allow a rear-end-side tip part of the application member to be exposed on a storage section side, the through-hole being shaped such that a width of a gap between the through-hole and the application member inserted into the through-hole is adjustable; a substantially cylindrical cap that caps a front-end-side opening of the body; and a breechblock inserted from a rear-end-side opening of the body to seal the storage section, wherein the breechblock is formed in a rod shape with a columnar stopper installed in a front end, a radial outer peripheral surface of the stopper is provided with a pressure absorbing portion including a swelling portion that swells in a mountain shape in an axial direction and recessed portions provided on both sides of the swelling portion, the breechblock is inserted into the rear-end-side opening of the body from a stopper side after storing the liquid application material in the storage section, and capping is performed by reducing an insertion pressure to the storage section by using the pressure absorbing portion.

Alternatively, three or more pressure absorbing portions are provided at least on a circular outer periphery of the stopper at intervals.

Advantageous Effects of Invention

Using the applicator according to the present invention, it is possible to provide an applicator capable of preventing distortion of the through-hole of the plug, reliably secure an air flow passage of the liquid application material, and prevent liquid leakage from the core material into which the liquid application material is infiltrated upon uncapping of the applicator.

BRIEF DESCRIPTION OF DRAWINGS

FIG. 6 is an explanatory diagram for describing a configuration of a plug of the prior art.

FIG. 7 is an explanatory diagram for describing a configuration of an applicator of the prior art.

DESCRIPTION OF EMBODIMENTS

Figure 1:
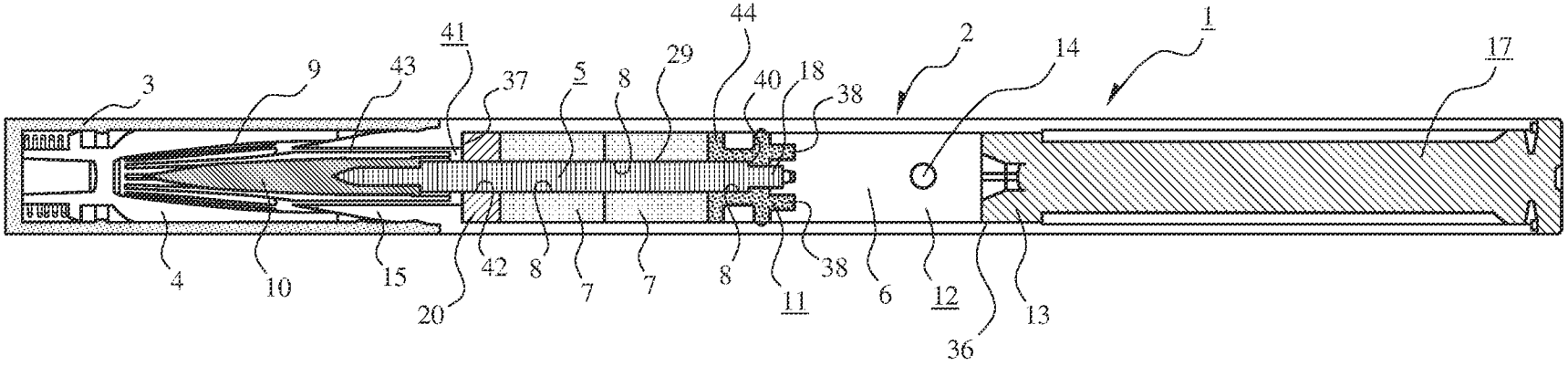
FIG. 1 is an explanatory diagram (1) for describing a configuration of an applicator according to the present invention.

Hereinafter, the present invention will be described on the basis of embodiments with reference to the accompanying drawings.

First, a configuration of an applicator 1 according to the present invention will be described with reference to FIG. 1.

The applicator 1 according to the present invention has a body 2 having a substantially cylindrical shape. In addition, the applicator 1 has a cap 3 and an inner cap 4. Here, the cap 3 and the inner cap 4 are connected and integrated to each other. When the cap 3 is removed from the body 2, the inner cap 4 is also removed from the body 2 at the same time.

The body 2 internally holds a core-shaped application member 5. The application member 5 is formed of a synthetic fiber member, and its outer peripheral surface is typically covered with a protective sheet material 29. While there is no limitation on the material of the protective sheet material 29, the protective sheet material 29 is formed of a material that is not impregnated much with the liquid application material 6 on the inner application member 5 side from the outer peripheral surface of the protective sheet material 29, and in the opposite case, not penetrated much.

The application member 5 is formed in a rod-like substantially columnar shape, and both axial ends of the application member 5 are configured such that the protective sheet material 29 is, for example, cut and peeled off, and the inside of the application member 5 can be impregnated with the liquid application material 6 from the both axial ends by virtue of a capillary phenomenon or the like.

That is, both end sides of the application member 5 are cut, and the protective sheet material 29 is peeled off as described above, so that a front end side has a substantially needle-like sharp tip shape, and a rear end side is configured as a substantially columnar protrusion 18 having a diameter smaller than that of the application member 5.

Reference numeral 7 refers to an absorber. As recognized from the drawing, the absorber 7 is formed in a columnar shape having no uneven shape on the outer peripheral surface, and a cylindrical through-hole 8 penetrating in an axial direction is provided in its central portion in the axial direction. In addition, the application member 5 described above is inserted into the through-hole 8.

In the prior art, the absorber 7 is manufactured as a resin-molded product having a bellows-shaped uneven surface on the outer periphery. However, as described above, since the mold cost of the resin-molded product is relatively high, manufacturing different absorbers having a plurality of shapes increases the cost of the applicator itself.

In contrast, the absorber 7 according to the present invention is formed of a flexible member having a gas-liquid exchange action such as a foam material having internal open cells and having an impregnating force for impregnating with the liquid application material, so that its shape can be changed by simply cutting the size or length. Furthermore, the absorber 7 is configured such that the shape can be easily changed by compressing in the longitudinal direction or the diametrical direction.

According to the present invention, one or a plurality of absorbers 7 are installed in series in the axial direction of the application member 5.

Reference numeral 9 refers to a nosepiece, which holds the front end side of the core-shaped application member 5 and is fixed to the front end part of the body 2. Here, the front end side of the body 2 is configured as a painting member holding portion 15 having a tapered shape.

Note that a painting member 10 is fitted and installed to the front end side of the application member 5, and the liquid application material 6 with which the painting member 10 is impregnated is used for painting or application.

Figure 2:
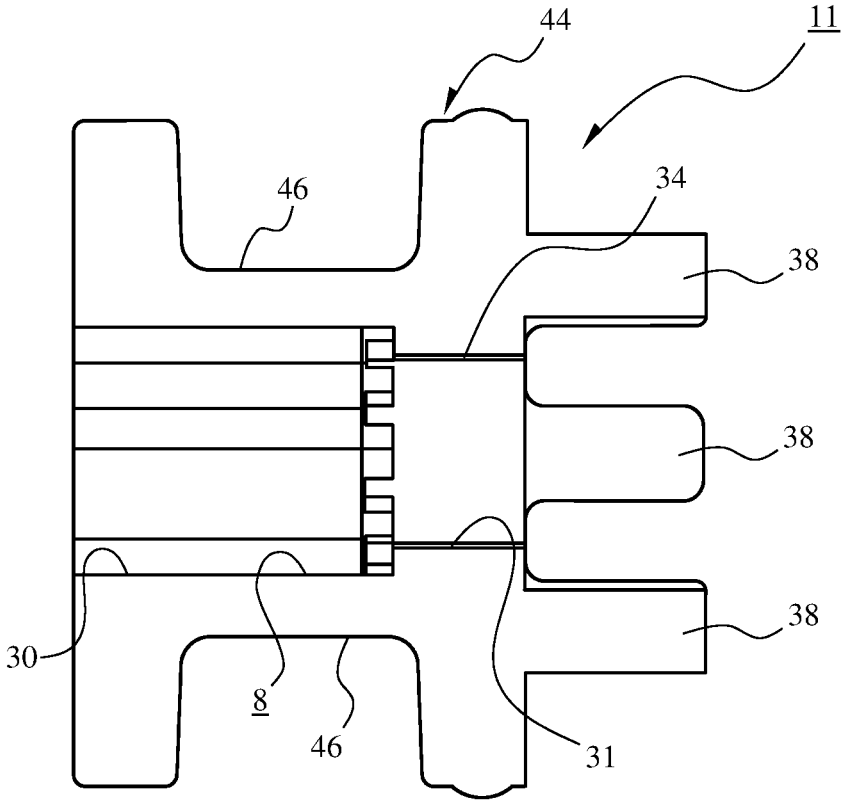
FIG. 2 is an explanatory diagram (1) for describing a configuration of a plug.
Figure 4:
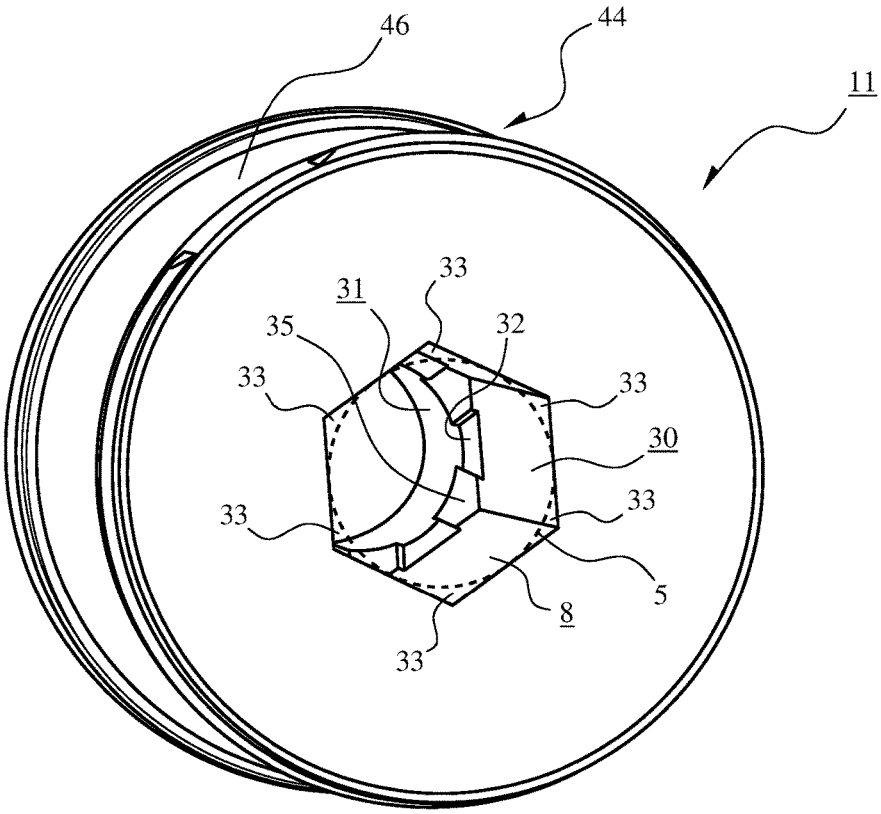
FIG. 4 is an explanatory diagram (2) for describing a configuration of a plug.

In FIGS. 2 and 4, reference numeral 11 refers to a plug. Inside the body 2, the rear end side of the application member 5 is inserted into and held by the bored through-hole 8, and the tip of the protrusion 18 provided in the rear end side of the application member 5 is exposed to the storage section 12 side formed in the vicinity.

Here, the through-hole 8 of the plug 11 has a first through-hole 30 having a diameter through which the application member 5 is inserted as recognized from the drawing described above.

The application member 5 is inserted into and held by the first through-hole 30, and the inner peripheral surface shape of the first through-hole 30 is not cylindrical but polygonal such as square, hexagonal, octagonal, or decagonal. This is an attempt to adjust the size or the number of polygonal gaps 33 generated between the polygonal inner peripheral surface of the first through-hole 30 and the outer peripheral surface of the application member 5 which is inserted through the first through-hole 30 and to adjust the infiltration amount of the liquid application material 6 infiltrated into the absorber 7 side, depending on the viscosity or material of the liquid application material 6.

Here, the polygonal gap 33 functions as a section of the air flow passage 41 that communicates the storage section 12 with the outside of the front end side of the painting member 10. Note that the liquid application material 6 is stored in the storage section 12.

In addition, the plug 11 according to the present invention has a second through-hole 31 communicating with the first through-hole 30. Furthermore, the second through-hole 31 is formed to have a diameter into which the protrusion 18 is inserted, that is, a hole having a diameter smaller than that of the first through-hole 30.

The hole shape of the second through-hole 31 is not limited particularly, but according to this embodiment, the second through-hole 31 is formed in a cylindrical shape. In addition, the protrusion 18 is inserted into the second through-hole 31. However, a ring-shaped gap 34 (see FIG. 2) is formed between the inner peripheral surface of the second through-hole 31 and the outer peripheral surface of the inserted protrusion 18, so that the ring-shaped gap 34 communicates with the aforementioned polygonal gap 33. The ring-shaped gap 34 also serves as a section of the air flow passage 41.

As recognized from the drawing, a step portion 32 is formed at the boundary between the first through-hole 30 and the second through-hole 31. In addition, the step portion 32 has a communication groove 35 formed to communicate the aforementioned polygonal gap 33 generated between the inner peripheral surface of the first through-hole 30 and the outer peripheral surface of the application member 5 inserted into the first through-hole 30 with the aforementioned ring-shaped gap 34 generated between the inner peripheral surface of the second through-hole 31 and the outer peripheral surface of the protrusion 18 into which the second through-hole 31 is inserted. As illustrated in the drawing, the communication groove 35 is formed by providing a depressed groove in the stepped wall 40 at the corner portion of the first through-hole 30 having a polygonal shape.

Therefore, the communication grooves 35 are formed as many as the number of corners of the first through-hole 30 having a polygonal shape. That is, in the case of the first through-hole 30 having a hexagonal shape, six communication grooves 35 are provided.

In the case of the plug 11 according to the present invention as described above, in the coating member 5, the step wall 40 formed at the boundary between the application member 5 and the protrusion 18 is locked to the step portion 32 of the plug 11, so that the application member 5 can be securely fixed inside the applicator 1. In addition, a space between the storage section 12 side and the front end side of the application member 5, that is, the outside near the front end side of the painting member 10 installed to the application member 5 is formed as a part of the air passage 41 that can provide the gas-liquid exchange, so as to achieve smooth impregnation of the liquid application material 6 from the storage section 12 to the application member 5.

That is, the air passage 41 is formed to extend from the storage section 12 to the ring-shaped gap 34 between the inner peripheral surface of the second through-hole 31 and the outer peripheral surface of the protrusion 18 inserted into the second through-hole 31, extend from the ring-shaped gap 34 to the space of the communication groove 35 provided in the step portion 32, extend to the polygonal gap 33 between the inner peripheral surface of the first through-hole 30 and the outer peripheral surface of the application member 5 inserted into the first through-hole 30, extend to the ring-shaped gap 42 or the inside of the absorber 7 provided between the inner peripheral surface of the through-hole 8 and the inner peripheral surfaces of a plurality of absorbers 7 and the compressing member 20, and extend to the body 2, specifically a spatial passage 43 between the painting member holding portion 15 and the nosepiece 9, and is then linked to the outside.

That is, the air passage 41 is configured to generate a gas-liquid exchange action such that the air can enter the storage section 12 from the outside as much as the amount of the liquid application material 6 with which the application member 5 is impregnated from the storage section 12.

Note that, as recognized from FIG. 2, the substantially columnar plug 11 according to the present invention has a substantially columnar plug base 44 and protrusions 38 protruding from a lateral surface side of the plug base 44 provided with the second through-hole 31. However, in the plug base 44 according to the present invention, the thickness in the radial direction on both end sides is used as the outer peripheral surface of the thickness of the plug base 44 as it is, and the outer peripheral surface of the center side has a ring-shaped depressed groove portion 46 depressed inward.

Here, the plug 11 is formed of a thermoplastic synthetic resin member, and is produced by putting the thermoplastic synthetic resin member into a mold, heating, molding, and then cooling it. However, in the plug 11 of the prior art illustrated in FIG. 6, the wall thickness of the plug base 44 in the radial direction is uniform. If the thermoplastic synthetic resin is put into the mold, heated, molded, and cooled with this thickness, as recognized from FIG. 6, the cooling rate of the inner portion of the plug base 44 and the cooling rate of the outer portion are different. As a result, the shrinkage rate of the thermoplastic synthetic resin member becomes different between the inner side and the outer side, and the first through-hole 30 or the like is contracted and distorted in the middle part.

If the accuracy of the first through-hole 30 or the like is insufficient in this way, the flow of the liquid application material 6 is finally hindered, and as a result, blurring or liquid leakage occurs upon use of the applicator 1.

Therefore, the inventors improved the mold such that a ring-shaped depressed groove portion 46 can be formed on the radial outer peripheral surface of the axial center side of the plug base 44, and formed the plug 11 by reducing the wall thickness of the plug 11 at the substantially central portion by using the mold. As a result, in the plug 11 according to the present invention, the cooling rate at the inner portion of the plug base 44 becomes substantially the same as the cooling rate at the outer portion. As a result, the shrinkage rate of the thermoplastic synthetic resin member becomes substantially the same between the inner side and the outer side, and distortion does not occur in the first through-hole 30 or the like.

Furthermore, the inventors also improved the cap 3 to prevent so-called pumping. As illustrated in FIG. 7, in the cap 3 of the prior art, the opening side portion of the cap 3 is not fabricated at all, and the thick wall of the cap 3 having a substantially cylindrical shape is formed to have the same thickness.

Therefore, when the cap 3 of the prior art is fitted into the front end side of the body 2 having a tapered shape, the inner cap 4 is pressed toward the painting member 10 side by the spring 47, and strong airtightness is generated in the space between the cap 3 and the painting member 10.

In addition, when the cap 3 is removed from the state where the strong airtightness is maintained, the liquid application material 6 impregnated from the painting member 10 or the spatial passage 43 is pulled, so as to generate liquid leakage or dripping (pumping action).

Figure 3:
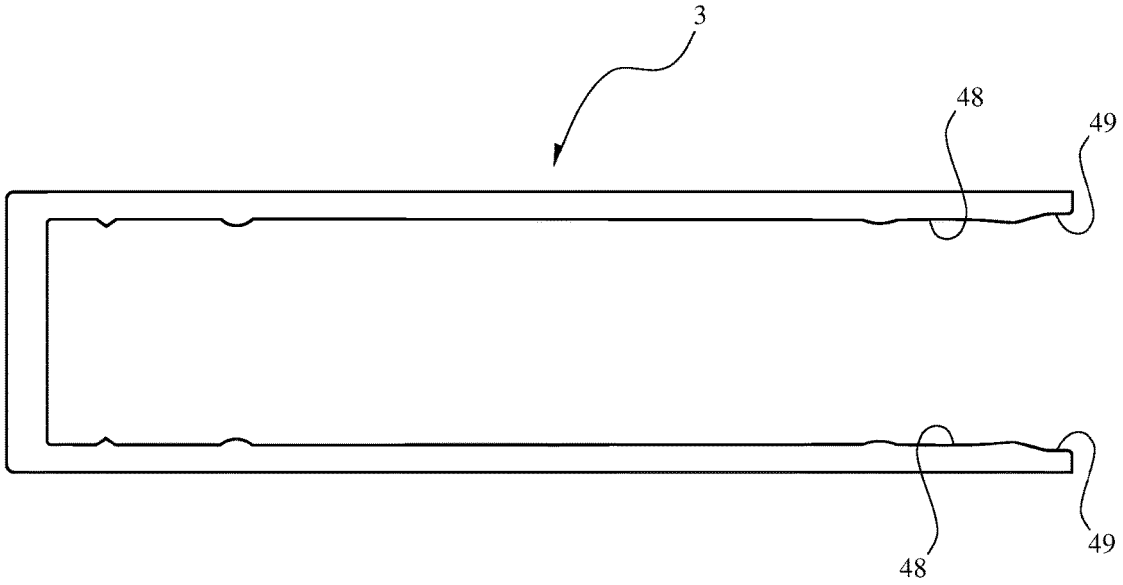
FIG. 3 is an explanatory diagram for describing a configuration of a cap.

In this regard, the inventors further improved the opening side of the cap 3. As illustrated in FIG. 3, the wall thickness of the cap 3 in the vicinity of the opening is formed on the sloped inner peripheral surface 49 so as to gradually decrease toward the opening side, that is, such that the diameter of the inner peripheral surface gradually increases. In addition, a depressed groove space portion 48 depressed in a ring shape is formed on the inner peripheral surface of the cap 3 having a substantially cylindrical shape at the inner portion in the axial direction from the portion where the sloped inner peripheral surface 49 is provided. That is, the depressed groove space portion 48 is provided as a space for temporarily releasing an internal pressure having airtightness.

Therefore, first, the cap 3 provided with the inner cap 4 is fitted into the body 2. Then, strong airtightness is generated inside the cap 3, and contact with the outside is cut off, so as to prevent inconveniences such as drying of the pen tip of the painting member 10. However, when the cap 3 is removed, the pressure inside the cap 3 increases abruptly, and the liquid application material 6 is pulled.

However, according to the present invention, when the cap 3 is removed, the airtightness is gradually reduced by the sloped inner peripheral surface 49, and the internal pressure having the airtightness is temporarily absorbed by the depressed groove space portion 48 depressed as the ring-shaped depressed groove. Then, the internal pressure with reduced airtightness, that is, the pressure equivalent to the external pressure is obtained. Therefore, even when the cap 3 is removed, the liquid application material 6 is not pulled from the painting member 10 or the spatial passage 43, so as to prevent the pumping action such as liquid leakage or liquid dripping.

Next, a breechblock 17 according to the present invention will be described. The breechblock 17 is provided with a stopper 13 at its front end. The breechblock 17 is configured as a rod-shaped member by installing the stopper 13 to the front end in this way.

Note that, in order to change the capacity of the liquid application material 6 stored in the storage section 12, the length of the breechblock 17 may be changed.

In FIG. 1, reference numeral 14 refers to a ball. Impregnation of the liquid application material 6 into the application member 5 can be promoted by storing the liquid application material 6 in the storage section 12 and putting the ball 14 into the storage section 12, so that the liquid application material 6 can be used without waste until the end. Note that an applicator 1 having no ball 14 may also be employed.

Figure 5:
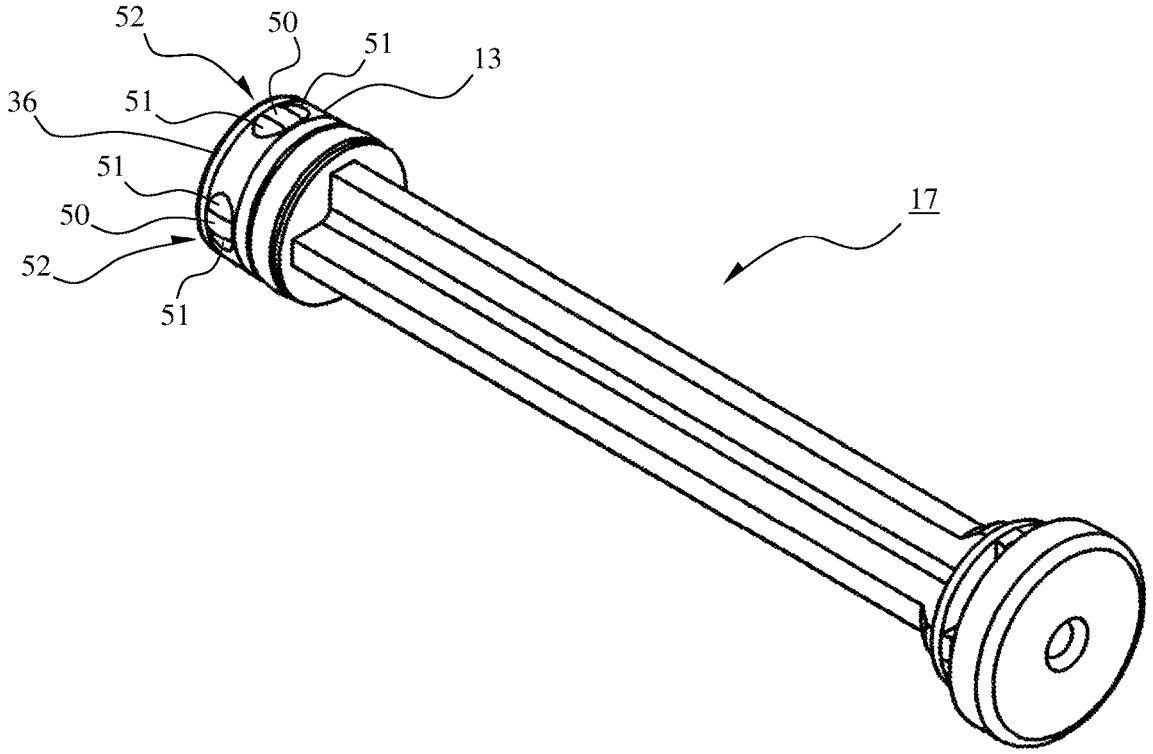
FIG. 5 is an explanatory diagram for describing a configuration of a breechblock provided with a stopper.

Here, as illustrated in FIG. 5, the radial outer peripheral surface of the stopper 13 is provided with a pressure absorbing portion 52 including a swelling portion 50 that swells in a mountain shape in the axial direction and recessed portions 51 provided on both sides of the swelling portion 50.

Here, the number of the pressure absorbing portions 52 is not particularly limited, but at least three or more pressure absorbing portions 52 are provided at least on the circular outer periphery at intervals.

The formation of the pressure absorbing portion 52 is also to prevent the pumping action. After storing the liquid application material 6 in the storage section 12, the breechblock 17 provided with the stopper 13 is inserted from the rear end side opening of the body 2 for capping. However, if the airtightness is too strong, the liquid application material 6 may leak (pumping) from the brush tip of the painting member 10. Therefore, by providing the pressure absorbing portion 52, the storage section 12 can be capped without applying strong pressure. Note that, according to this embodiment, four pressure absorbing portions 52 are provided at intervals on the outer periphery of the stopper 13.

As described above, the painting member 10 is installed to the tip side in the body 2 through the nosepiece 9, and the core-shaped application member 5 installed with a compressing member 20 having a desired length, one or a plurality of absorbers 7 cut to a desired length, and the plug 11 is installed substantially in the middle of the body 2. Then, the liquid application material 6 is filled into the storage section 12 having a desired area space from the rear end opening 15 of the body 2, and is capped by the breechblock 17 provided with the stopper 13, so that the liquid application material 6 is stored in the storage section 12.

The stopper 13 has a sealing projection 36 that projects outward in a ring shape on the rear outer peripheral surface provided with the pressure absorbing portion 52 for sealing between the inner peripheral surface of the body 2 and the outer surface of the stopper 13 to prevent the liquid application material 6 from leaking to the outside from a gap therebetween.

Furthermore, sealing is provided also between an outer side surface of the compressing member 20 and an inner side surface of the body 2. The sealing portion is indicated by reference numeral 37. The sealing portion 37 prevents the liquid application material 6 from leaking from a gap between the compressing member 20 and the body 2 to the spatial passage 43 side described above.

Note that, while the ball 14 for stirring the liquid application material 6 is provided inside the storage section 12 that stores the liquid application material 6 as described above, a plurality of collision-preventing projections 38 for preventing the ball 14 from colliding with the protrusion 18 are provided to surround the protrusion 18 on the end surface of the plug 11 of the storage section 12 side. As a result, it is possible to prevent occurrence of liquid leakage resulting from a change of the shape of the protrusion 18 and a change of the impregnation efficiency for impregnating with the liquid application material 6 of the application member 5 when the ball 14 abuts on the front end of the protrusion 18.

Meanwhile, the viscosity of the liquid application material 6 varies depending on the type. Therefore, in the case of the liquid application material 6 having low viscosity, liquid leakage may occur from the painting member 10 side installed to the front end of the application member 5.

In this regard, in the prior art, in order to prevent this liquid leakage, a single absorber 7 is employed, and the applicator is manufactured by changing the length of the absorber 7 or the size of the storage section 12. According to the present invention, liquid leakage is perfectly prevented by adding further improvement.

According to the invention illustrated in FIG. 1, even when the applicators 1 have the same length and the same size, an applicator 1 that does not generate liquid leakage depending on the type of bulk viscosity or an applicator 1 that has high bulk viscosity but does not generate liquid blurring can be configured as the applicator 1 having one type of size described above.

In particular, in a situation that the applicator 1 is used by a user boarding on an airplane and staying in the sky at a high altitude, liquid leakage often occurs due to a change of the atmospheric pressure. According to the present invention, the applicator 1 does not suffer from liquid leakage in such a situation.

That is, a plurality of absorbers 7 are installed inside the body 2 of the applicator 1 in series in the axial direction, and the compressing member 20 having a substantially columnar shape in the vicinity of a plurality of the installed absorbers 7 and having a predetermined length is installed. As a result, compression can be made by changing the compression level for each of the plurality of absorbers 7.

If the compression level is different, the lengths of the plurality of absorbers 7 become different, and as a result, the suction efficiency of the liquid application material 6 becomes different for each absorber 7.

If the compression level is different upon compressing the absorber 7 in the axial direction, the density of internal bubbles changes because the absorber 7 is a foam material having open cells. Then, the capillary phenomenon for sucking up the liquid application material 6 is also different, and the suction efficiency of the liquid application material 6 also changes in the axial direction of the plurality of installed absorbers 7.

As recognized from FIG. 1, typically, a single compressing member 20 having a predetermined length is installed to the painting member 10 side. In addition, the absorber 7 adjacent to the compressing member 20 has the highest compression level, and as a result, the suction efficiency of the liquid application material 6 by virtue of the capillary phenomenon is improved.

However, unlike the adjacent absorber 7, the absorber 7 that does not come into contact with the compressing member 20 is not compressed so much. Therefore, the suction efficiency of the liquid application material 6 by virtue of the capillary phenomenon at this location is not so high.

In this manner, a plurality of absorbers 7 are installed side by side in series in the axial direction of the application member 5, and they are compressed by the compressing member 20 by changing the compression level for each absorber 7 to change the suction efficiency of the liquid application material 6 caused by the capillary phenomenon of the body 7. As a result, it is possible to provide an applicator 1 capable of coping with the liquid application material 6 having different viscosities and preventing liquid leakage.

Here, as described above, the absorbers 7 are formed of a foam material having internal open cells. In addition, as recognized from the drawings, the absorber 7 has a through-hole 8 into which the application member 5 is inserted in the axial direction.

In addition, when the compressing member 20 is installed in one side of the absorber 7, the absorber 7 is compressed in the longitudinal direction by the length of the installed compressing member 20. That is, for example, assuming that the absorber 7 has a total length of 20 mm, and the compressing member 20 having a length of 4 mm is installed, the absorber 7 is compressed and shrinks to a total length of 16 mm.

When the plurality of absorbers 7 are compressed to the corresponding compression levels, the absorber 7 formed of a foam material having internal open cells has stronger adherence to the application member 5 inserted into the through-hole 8, so that the liquid application material 6 with which the application member 5 side is impregnated is sucked up by virtue of the capillary phenomenon. Therefore, the application member 5 or the painting member 10 side is not impregnated with the excess liquid application material 6, and as a result, it is possible to prevent liquid leakage of the liquid application material 6.

REFERENCE SIGNS LIST

1 applicator
2 body
3 cap
4 inner cap
5 application member
6 liquid application material
7 absorber
8 through-hole
9 nosepiece
10 painting member
11 plug
12 storage section
13 stopper
14 ball
15 painting member holding portion
17 breechblock
18 protrusion
20 compressing member
29 protective sheet material
30 first through-hole
31 second through-hole
32 step portion
33 polygonal-shaped gap
34 ring-shaped gap
35 communication groove
36 sealing projection
37 sealing portion
38 projection
40 stepped wall
41 air flow passage
42 ring-like gap
43 spatial passage
44 plug base
46 depressed groove portion
47 spring
48 depressed groove space portion
49 sloped inner peripheral surface
50 swelling portion
51 recessed portion
52 pressure absorbing portion

The invention claimed is:

1. An applicator comprising:

a substantially cylindrical body;

a substantially columnar application member housed in the body;

a storage section that stores a liquid application material with which the application member is impregnated;

a substantially columnar plug that is positioned on a rear end side of the application member in the body so as to allow the application member to be inserted into and held by a through-hole bored in the plug and allow a rear-end-side tip part of the application member to be exposed on a storage section side, the through-hole being shaped such that a width of a gap between the through-hole and the application member inserted into the through-hole is adjustable; and a substantially cylindrical cap that caps a front-end-side opening of the body, wherein the cap has a sloped inner peripheral surface formed such that a thickness of an inner peripheral surface in a vicinity of an opening of the cap is gradually reduced toward an opening side, and a diameter of the inner peripheral surface increases, and a depressed groove space portion depressed in a ring shape is formed on the inner peripheral surface of the cap inward of the portion where the sloped inner peripheral surface is formed in a cap axial direction, so as to cause the depressed groove space portion to serve as a space for releasing an internal pressure of the cap.

2. An applicator comprising:

a substantially cylindrical body;

a substantially columnar application member housed in the body;

a storage section that stores a liquid application material with which the application member is impregnated;

a substantially columnar plug that is positioned on a rear end side of the application member in the body so as to allow the application member to be inserted into and held by a through-hole bored in the plug and allow a rear-end-side tip part of the application member to be exposed on a storage section side, the through-hole being shaped such that a width of a gap between the through-hole and the application member inserted into the through-hole is adjustable;

a substantially cylindrical cap that caps a front-end-side opening of the body; and a breechblock inserted from a rear-end-side opening of the body to seal the storage section, wherein the breechblock is formed in a rod shape with a columnar stopper installed in a front end, a radial outer peripheral surface of the stopper is provided with a pressure absorbing portion including a swelling portion that swells in a mountain shape in an axial direction and recessed portions provided on both sides of the swelling portion, the breechblock is inserted into the rear-end-side opening of the body from a stopper side after storing the liquid application material in the storage section, and capping is performed by reducing an insertion pressure to the storage section by using the pressure absorbing portion.

3. The applicator according to claim 2, wherein three or more pressure absorbing portions are provided at least on a circular outer periphery of the stopper at intervals.

* * * * *